US010343859B2

(12) United States Patent
Okazaki

(10) Patent No.: US 10,343,859 B2
(45) Date of Patent: Jul. 9, 2019

(54) SHEET SUPPORTING APPARATUS AND IMAGE FORMING APPARATUS

(71) Applicant: CANON KABUSHIKI KAISHA, Tokyo (JP)

(72) Inventor: Shunsuke Okazaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/884,486

(22) Filed: Jan. 31, 2018

(65) Prior Publication Data

US 2018/0222700 A1 Aug. 9, 2018

(30) Foreign Application Priority Data

Feb. 7, 2017 (JP) ..... 2017-020773

(51) Int. Cl.
*B65H 7/04* (2006.01)
*B65H 1/14* (2006.01)
(Continued)

(52) U.S. Cl.
CPC ..... *B65H 1/14* (2013.01); *B65H 1/04* (2013.01); *B65H 3/0684* (2013.01); *B65H 7/04* (2013.01);
(Continued)

(58) Field of Classification Search
CPC ... B65H 7/14; B65H 7/04; B65H 7/02; B65H 1/14; B65H 1/18; B65H 1/04; B65H 1/266; B65H 2511/152; B65H 2511/15; B65H 2511/51; B65H 2511/212; B65H 2553/612
See application file for complete search history.

(56) References Cited

U.S. PATENT DOCUMENTS 5,897,112 A * 4/1999 Kwag ..... G03G 15/6502 271/111
8,042,801 B2 * 10/2011 You ..... B65H 1/266 271/147
(Continued)

FOREIGN PATENT DOCUMENTS

JP 2001-122472 A 5/2001
JP 2006-069702 A 3/2006
(Continued)

OTHER PUBLICATIONS

Masatoshi Yoshida et al., U.S. Appl. No. 15/880,694, filed Jan. 26, 2018.

*Primary Examiner* — Luis A Gonzalez
(74) *Attorney, Agent, or Firm* — Venable LLP

(57) ABSTRACT

A sheet supporting apparatus includes a sheet supporting portion, a regulation member, a flag portion, a detection portion, and a holding portion con. At the holding position, the holding portion supports the flag portion at the upper position in a case where the sheet supporting portion is positioned at the first position, and, at the allowing position, the holding portion allows movement of the flag portion to the lower position in a case where the sheet supporting portion is positioned at the second position. A lower end of the flag portion is positioned above the regulation surface in a case where the flag portion is positioned at the upper position, and is positioned below the regulation surface in a case where the flag portion is positioned at the lower position.

9 Claims, 11 Drawing Sheets

(51) Int. Cl.
*B65H 1/04* (2006.01)
*G03G 15/00* (2006.01)
*B65H 3/06* (2006.01)

(52) U.S. Cl.
CPC ..... *G03G 15/6502* (2013.01); *G03G 15/6511* (2013.01); *B65H 2403/544* (2013.01); *B65H 2403/92* (2013.01); *B65H 2403/942* (2013.01); *B65H 2405/111* (2013.01); *B65H 2405/15* (2013.01); *B65H 2511/212* (2013.01); *B65H 2511/51* (2013.01); *B65H 2553/612* (2013.01); *B65H 2601/252* (2013.01); *B65H 2601/271* (2013.01)

(56) References Cited

U.S. PATENT DOCUMENTS 8,282,093 B2 * 10/2012 Sugishima ..... B65H 1/266 271/152
8,641,037 B2 * 2/2014 Tokuda ..... B65H 1/266 271/162
8,714,543 B2 5/2014 Matsushima et al.
9,126,789 B2 9/2015 Hori et al.
9,840,382 B2 12/2017 Okazaki et al.
2014/0203496 A1 * 7/2014 Hamasaki ..... B65H 1/266 271/18
2014/0353907 A1 * 12/2014 Hara ..... B65H 7/06 271/162
2016/0046457 A1 * 2/2016 Ishikawa ..... B65H 7/02 271/265.01
2016/0279979 A1 * 9/2016 Kohama ..... B65H 1/266
2017/0217707 A1 8/2017 Fujinuma et al.
2018/0050878 A1 2/2018 Okazaki et al.

FOREIGN PATENT DOCUMENTS

JP 2009-161281 A 7/2007
JP 2016-132557 A 7/2016

* cited by examiner

SHEET SUPPORTING APPARATUS AND IMAGE FORMING APPARATUS

BACKGROUND OF THE INVENTION

Field of the Invention

The present invention relates to a sheet supporting portion configured to support a sheet and to an image forming apparatus including the sheet supporting apparatus.

Description of the Related Art

Conventionally, Japanese Patent Laid-Open No. 2016-132557 has proposed a sheet feeding apparatus that supports a sheet on a push-up plate supported in a sheet feeding cassette to be ascendible and descendible and includes a sheet detection portion configured to detect the presence or absence of the sheet supported on the push-up plate. This sheet detection portion includes a sheet feeding sensor, an abutment member, and a shutter member. The abutment member follows the sheet supported on the push-up plate, and the shutter member moves along with the abutment member. In the case where no sheet is supported on the push-up plate any longer, the abutment member comes down into a hole defined in the push-up plate, and the shutter member moves along with the abutment member. As a result of this, the shutter member blocks an optical path of the sheet feeding sensor constituted by an optical sensor, and it is detected that no sheet is present on the push-up plate any longer.

However, in the sheet feeding apparatus disclosed in Japanese Patent Laid-Open No. 2016-132557, since the abutment member and the shutter member are provided in an insertion locus of a sheet, the sheet sometimes comes into contact with the abutment member and the shutter member when a user sets the sheet on the push-up plate. Therefore, there is a possibility that the sheet is deformed and causes a jam and that the abutment member or the shutter member is damaged. In addition, in recent years, there has been a request for detecting the presence or absence of a sheet accommodated in a sheet feeding apparatus without increasing the size of the sheet feeding apparatus in the height direction or reducing the amount of sheets that can be supported in the sheet feeding apparatus.

SUMMARY OF THE INVENTION

According to one aspect of the present invention, a sheet supporting apparatus includes a sheet supporting portion configured to support a sheet and supported to be ascendible and descendible between a first position and a second position, a regulation member including a regulation surface configured to regulate a height of the sheet supported by the sheet supporting portion, a flag portion supported to be movable between an upper position and a lower position and configured to be positioned at the lower position in a case where the sheet is not supported by the sheet supporting portion positioned at the second position, a detection portion configured to detect that the flag portion is positioned at the lower position, and a holding portion configured to move between a holding position and an allowing position. At the holding position, the holding portion supports the flag portion at the upper position in a case where the sheet supporting portion is positioned at the first position, and, at the allowing position, the holding portion allows movement of the flag portion to the lower position in a case where the sheet supporting portion is positioned at the second position. A lower end of the flag portion is positioned above the regulation surface in a case where the flag portion is positioned at the upper position, and is positioned below the regulation surface in a case where the flag portion is positioned at the lower position.

Further features of the present invention will become apparent from the following description of exemplary embodiments with reference to the attached drawings.

DESCRIPTION OF THE EMBODIMENTS

First Exemplary Embodiment

Overall Configuration

Figure 1:
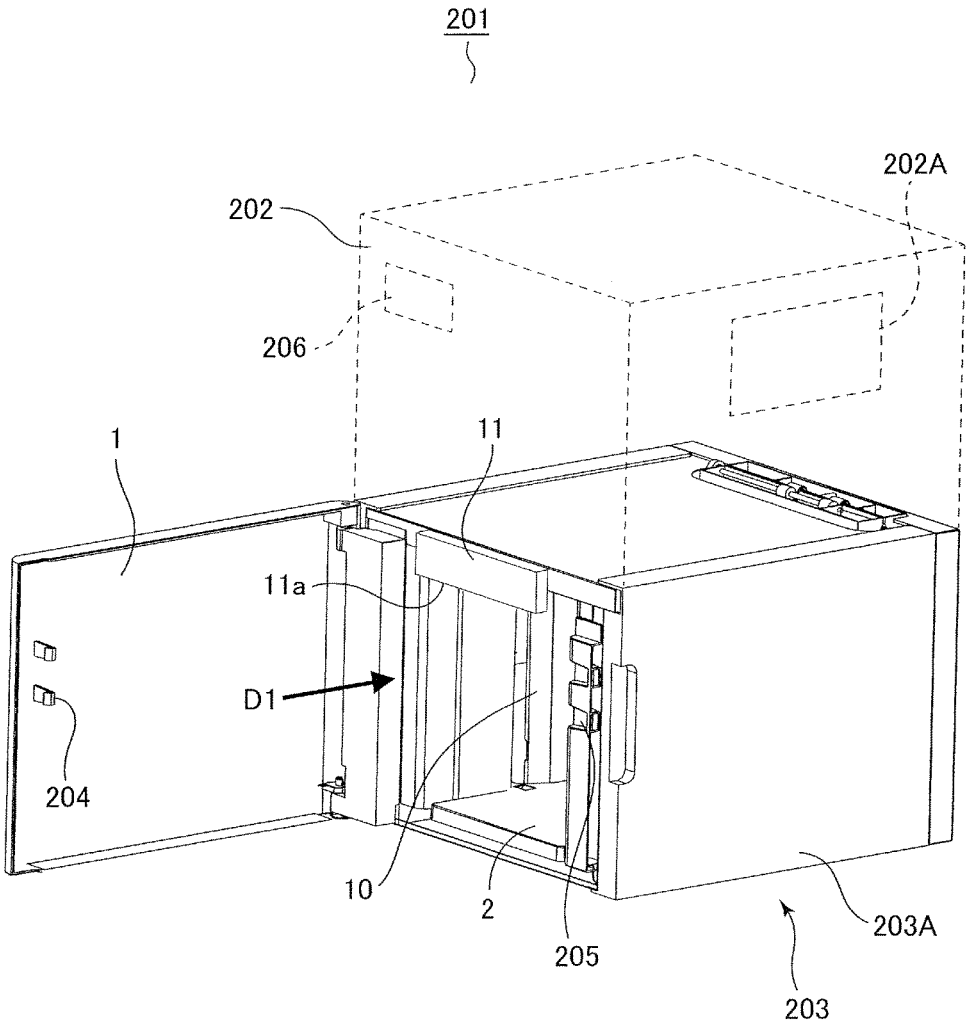
FIG. 1 is a perspective view of a printer according to a first exemplary embodiment.

First, a first exemplary embodiment of the present invention will be described. A printer 201 serving as an image forming apparatus according to a first exemplary embodiment is a laser beam printer using an electrophotographic system. As illustrated in FIG. 1, the printer 201 includes a printer body 202 and a feeding apparatus 203. The printer body 202 accommodates an image forming portion 202A that forms an image on a sheet. The feeding apparatus 203 is connected to a lower portion of the printer body 202 and serves as a sheet supporting apparatus that supports a sheet.

The feeding apparatus 203 includes a body portion 203A and a front cover 1. The front cover 1 is openably and closably supported by the body portion 203A and is provided on the front side of the printer 201, and the inside of the feeding apparatus 203 is exposed when the front cover 1 is opened. When setting sheets in the feeding apparatus 203, a user inserts sheets in a sheet inserting direction D1, and thus sets the sheets on a tray 2 capable of ascending and descending. In the case where the front cover 1 is closed by the user, an engagement portion 204 provided on the front cover 1 is engaged with an engaged portion 205 provided on the feeding apparatus 203 and is thus locked. A regulation member 11 is provided on the upstream side of the body portion 203A in the sheet inserting direction D1. The regulation member 11 is configured to hinder the tray 2 from being overloaded with sheets. The regulation member 11 regulates, by a regulation surface 11*a* that is a lower surface thereof, the height of sheets that can be inserted to be supported on the tray 2.

Figure 2:
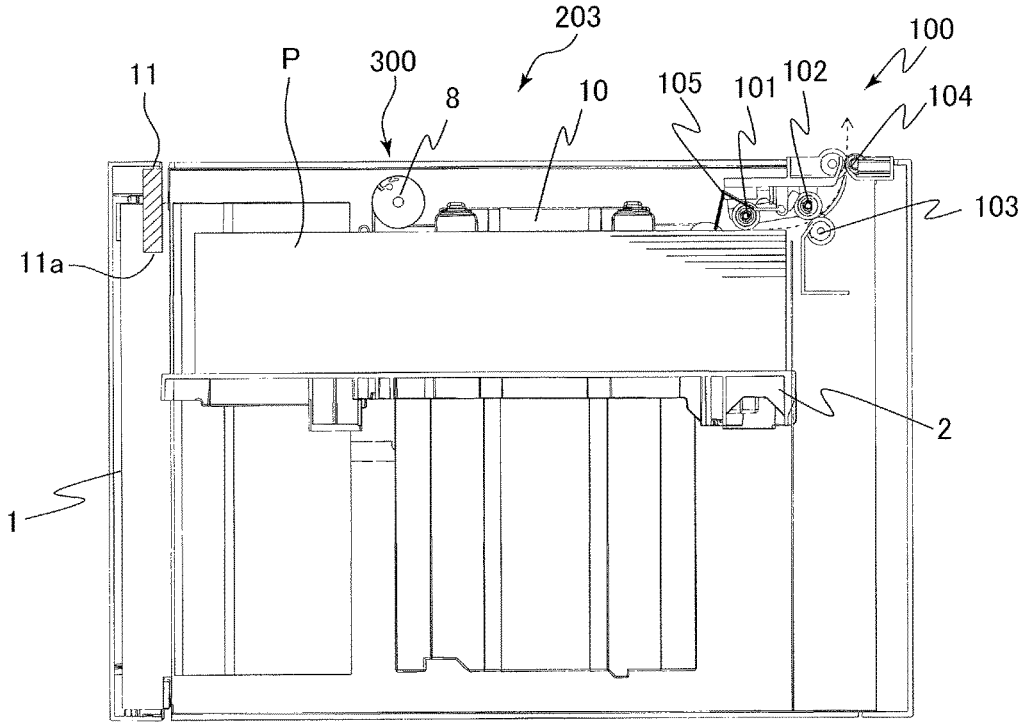
FIG. 2 is a side view of a feeding apparatus.

As illustrated in FIG. 2, the feeding apparatus 203 includes the tray 2, a side regulating plate 10, a feeding unit 100, and a lift-up mechanism 300. The tray 2 serves as a sheet supporting portion that supports a sheet, and the side regulating plate 10 regulates the position of an end portion of the sheet in the width direction. The feeding unit 100 includes a pickup roller 101, a feed roller 102, a separation roller 103, and a conveyance roller pair 104. The pickup roller 101 serves as a feeding portion configured to feed a sheet P supported on the tray 2.

Figure 3:
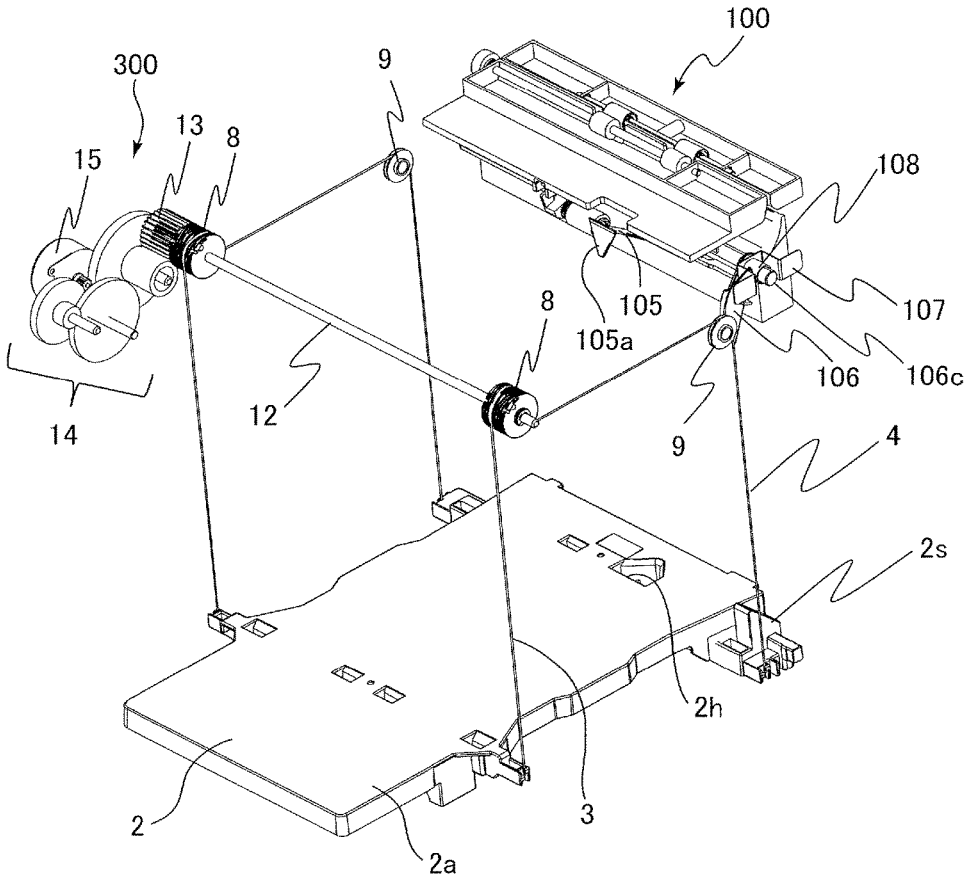
FIG. 3 is a perspective view of a lift-up mechanism.

As shown in FIG. 3, the lift-up mechanism 300 includes a lifter motor 15, a gear train 14, and a drum shaft 12. The gear train 14 is coupled to the lifter motor 15. Wind-up drums 8 and a drum gear 13 are fixed to the drum shaft 12. Wires 3 and 4 are coupled to the tray 2 is wound around the wind-up drums 8. The drum gear 13 is engaged with the gear train 14. The wire 4 is coupled to the tray 2 via a pulley 9.

When a feeding signal is transmitted from a controller 206 of the printer 201 illustrated in FIG. 1, the lifter motor 15 drives, and a driving force is decelerated by the gear train 14 and transmitted to the drum shaft 12. When the drum shaft 12 rotates, the wind-up drum 8 winds up the wires 3 and 4, and the tray 2 ascends. Then, when the top surface of sheets P supported on the tray 2 ascends to a predetermined position, the pickup roller 101 feeds the topmost sheet of the sheets P. In the case where a plurality of sheets are fed by the pickup roller 101, one sheet is separated from the sheets by the feed roller 102 and the separation roller 103, and is further conveyed toward the image forming portion 202A of the printer body 202 by the conveyance roller pair 104. Then, an image is formed on the sheet by the image forming portion 202A, and the sheet is discharged to the outside of the printer 201. To be noted, an image forming process performed by the image forming portion 202A is a known process, and thus the description thereof is omitted herein.

To be noted, the ascending timing of the tray 2 is not limited to the timing of input of a print job, and the tray 2 may ascend at a timing of, for example, closing the front cover 1. In addition, although the tray 2 descends when the lifter motor 15 rotates in a reverse direction, the tray 2 may be configured to descend due to the weight of the tray 2 and sheets on the tray 2 when the lifter motor 15 is turned off. To be noted, a hole 2*h* is defined in a supporting surface 2*a* of the tray 2 on which sheets are supported, and an abutment portion 105*a* of a flag member 105 that will be described later is capable of coming down into the hole 2*h*.

Feeding Unit

Figure 4:
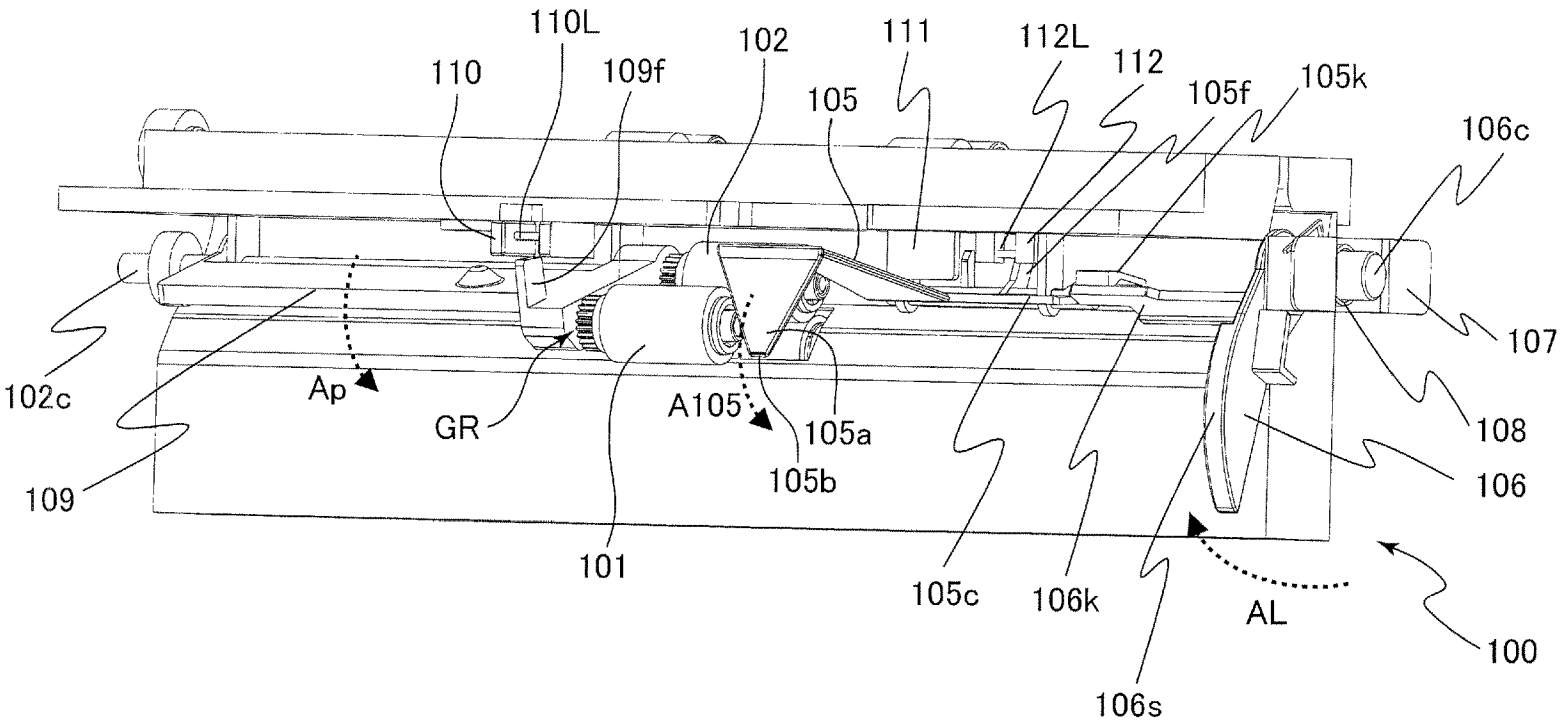
FIG. 4 is a perspective view of a feeding unit.
Figure 5:
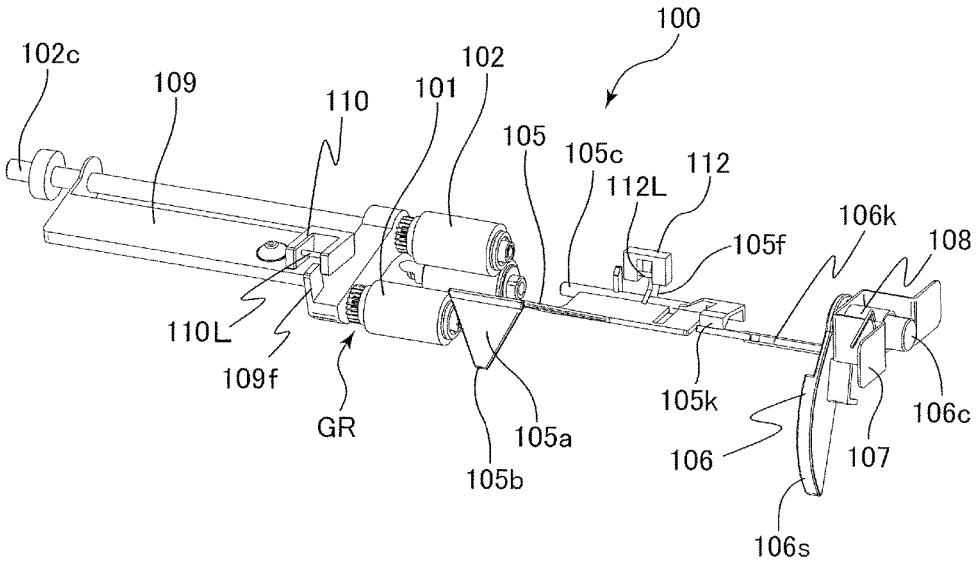
FIG. 5 is a perspective view of the feeding unit.

Next, the feeding unit 100 will be described in more detail with reference to FIGS. 4 and 5. As illustrated in FIGS. 4 and 5, the feeding unit 100 includes a pick arm shaft 102*c*, a flag shaft 105*c*, a sheet surface sensor 110, and a sheet presence/absence sensor 112. The pick arm shaft 102*c* and the flag shaft 105*c* are rotatably supported by the body portion 203A illustrated in FIG. 1. The feed roller 102 is fixed to the pick arm shaft 102*c*, and a pick arm 109 is supported by the pick arm shaft 102*c* to be relatively rotatable. The pickup roller 101 is rotatably held on an end side of the pick arm 109, and drive is transmitted from the feed roller 102 to the pickup roller 101 through a gear train GR.

Figure 7:
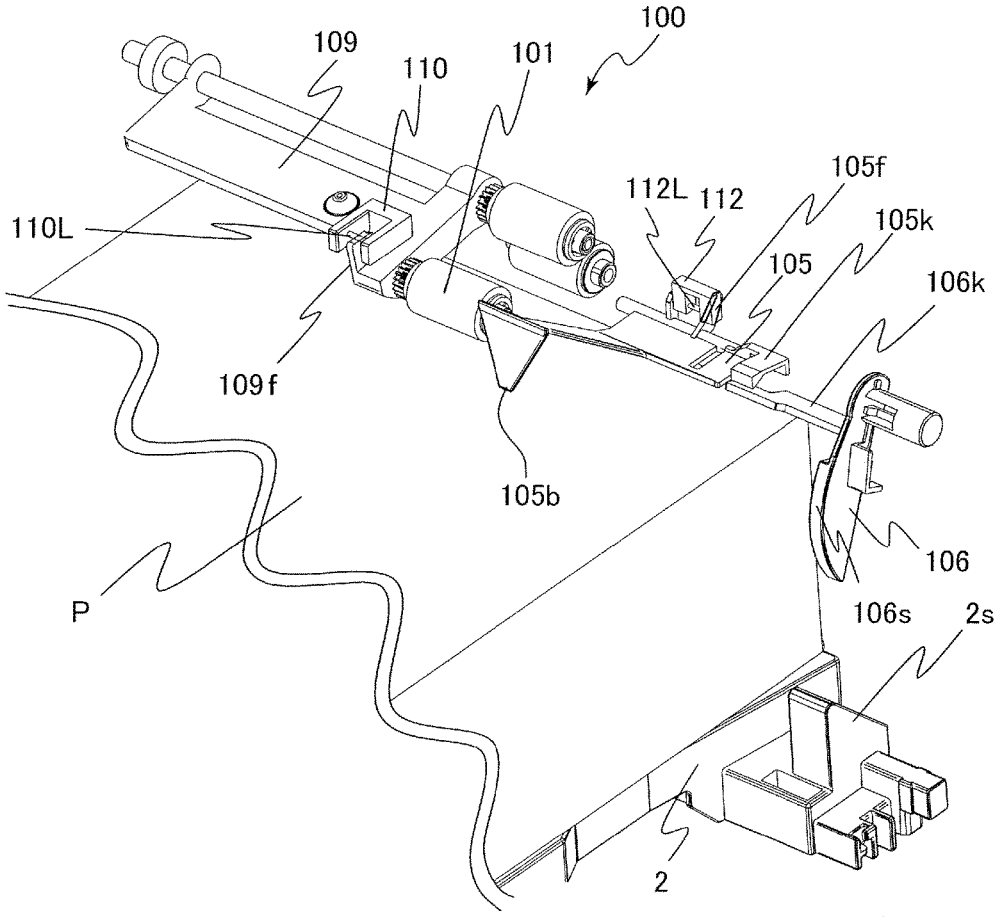
FIG. 7 is a perspective view of the feeding unit at the time of feeding.

The pick arm 109 is urged in an arrow Ap direction illustrated in FIG. 4 by an urging member that is not illustrated, and is held at a waiting position by a stopper that is not illustrated. In addition, a sheet surface flag 109*f* projects upward from the pick arm 109, and the sheet surface flag 109*f* is capable of blocking an optical path 110L of the sheet surface sensor 110. When the tray 2 is caused to ascend by the lift-up mechanism 300 described above, a sheet P supported by the tray 2 comes into contact with the pickup roller 101 held by the pick arm 109 positioned at the waiting position. Then, the pick arm 109 also ascends along with the pickup roller 101 ascending together with the tray 2. The pick arm 109 is stopped in the case where the pickup roller 101 is at a feeding position suitable for feeding and the sheet surface flag 109*f* is detected by the sheet surface sensor 110 as illustrated in FIG. 7.

As illustrated in FIGS. 4 and 5, the flag shaft 105*c* is integrally provided with the flag member 105 serving as a flag portion, and, the abutment portion 105*a* having a triangular shape bent downward is formed on the distal end of the flag member 105. The flag member 105 is movable between an upper position and a lower position, and is urged in an arrow A105 direction illustrated in FIG. 4 by its own weight due to the abutment portion 105*a* serving as a heavy part. That is, the flag member 105 is urged toward the lower position by its own weight. A lower end 105*b* of the abutment portion 105*a* is configured to abut and follow the upper surface of the sheet P supported by the tray 2. In addition, the flag member 105 includes a blocking portion 105*f* and a contact portion 105*k*. The blocking portion 105*f* is capable of blocking an optical path 112L of the sheet presence/absence sensor 112, and the contact portion 105*k* is capable of coming into contact with a cam portion 106*k* of a separation lever 106 that will be described later. The sheet presence/absence sensor 112 serving as a detection portion is capable of detecting that no sheet is supported by the tray 2 when the optical path 112L is blocked by the blocking portion 105*f*. At this time, the flag member 105 is positioned at the lower position.

A stay 107 is provided in a side portion of the feeding unit 100, and the separation lever 106 is supported by the stay 107 to be pivotable about a pivot center 106*c*. The stay 107 is fixed to the body portion 203A illustrated in FIG. 1. The separation lever 106 serving as a holding portion is configured to pivot between a holding position illustrated in FIG. 5 and an allowing position illustrated in FIG. 8, and is urged toward the holding position in an arrow AL direction illustrated in FIG. 4 by a separation spring 108. The separation spring 108 serving as an urging portion is constituted by a torsion spring, and the separation lever 106 is pressed to abut the stay 107 and is thus positioned at the holding position.

The separation lever 106 includes the cam portion 106*k* and a pressed portion 106*s*. The cam portion 106*k* extends in the axial direction of the flag shaft 105*c*, and is capable of coming into contact with the contact portion 105*k* of the flag member 105. The pressed portion 106*s* is disposed to be capable of being pressed by a pressing portion 2*s* formed on a side portion of the tray 2 as illustrated in FIG. 7. When the pressed portion 106*s* of the separation lever 106 is separated from the pressing portion 2*s* of the tray 2, the separation lever 106 is positioned at the holding position by the separation spring 108 and the stay 107. At this time, the cam portion 106*k* of the separation lever 106 is in contact with the contact portion 105*k* of the flag member 105 and thus holds the flag member 105 at the upper position. That is, at the holding position, the separation lever 106 holds the flag member 105 at the upper position.

In addition, when the pressed portion 106*s* of the separation lever 106 is pressed by the pressing portion 2*s* of the tray 2 that is ascending, the separation lever 106 pivots from the holding position toward the allowing position against the urging force of the separation spring 108. Then, the cam portion 106*k* of the separation lever 106 is separated from the contact portion 105*k* of the flag member 105, and the separation lever 106 allows, at the allowing position, the movement of the flag member 105 to the lower position.

Position of Flag Member

Figure 6:
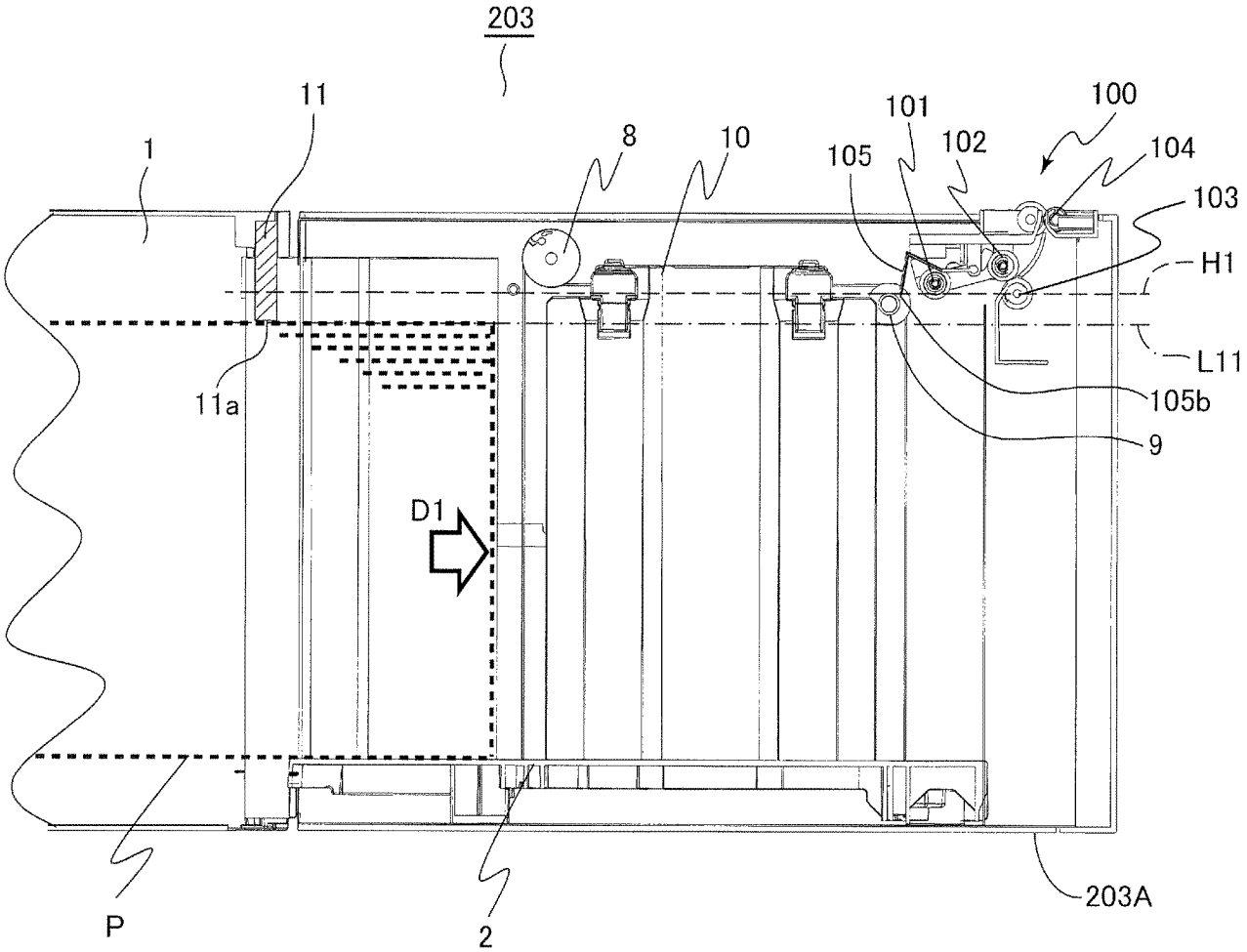
FIG. 6 is a side view of the feeding apparatus for describing the position of a flag member positioned at an upper position.

Next, the transition of the position of the flag member 105 from setting sheets until no sheet is supported by the tray 2 will be described in detail. First, when a user sets sheets P, as illustrated in FIG. 6, the user opens the front cover 1 of the feeding apparatus 203 and inserts the sheets P in the body portion 203A in the sheet inserting direction D1. At this time, the height of the inserted sheets P is restricted by the regulation surface 11*a* of the regulation member 11. In addition, since the tray 2 is positioned at a lower limit position serving as a first position, the flag member 105 is held at the upper position by the separation lever 106 illustrated in FIG. 5.

In addition, the lower end 105*b* of the flag member 105 is positioned above the regulation surface 11*a* when the flag member 105 is positioned at the upper position. That is, a height H1 of the lower end 105*b* of the flag member 105 positioned at the upper position is higher than a height L11 of the regulation surface 11*a*. According to this, the sheets P do not interfere with the flag member 105 when the user inserts the sheets P in the body portion 203A, and occurrence of a jam caused by deformation of a sheet and damaging of the flag member 105 can be suppressed. To be noted, the pickup roller 101 is disposed such that, at the waiting position, the lower end thereof is substantially at the same height as the height L11 of the lower end 105*b* of the flag member 105, and thus the insertion of the sheets P is not hindered by the pickup roller 101.

When a print job is input in the printer 201, the tray 2 ascends, and the sheet surface flag 109*f* of the pick arm 109 is detected by the sheet surface sensor 110 as illustrated in FIG. 7. As a result of this, the lifter motor 15 illustrated in FIG. 3 stops, and thus the pick arm 109 stops at the feeding position. At this time, the lower end 105*b* of the flag member 105 is in contact with the upper surface of a sheet P, and slides on the sheet P being fed by the pickup roller 101. To be noted, the flag member 105 may pivot slightly upward from the upper position by coming into contact with the upper surface of the sheet P. In this case, the contact portion 105*k* is separated from the cam portion 106*k* of the separation lever 106 positioned at the holding position.

As the sheet P supported by the tray 2 is fed, the pickup roller 101 and the pick arm 109 gradually descend. Then, when the sheet surface sensor 110 no longer detects the sheet surface flag 109*f* and is thus turned off, the lifter motor 15 is driven until the sheet surface sensor 110 is turned on, and thus the position of the upper surface of the sheet P supported by the tray 2 is maintained in a certain range.

Figure 8:
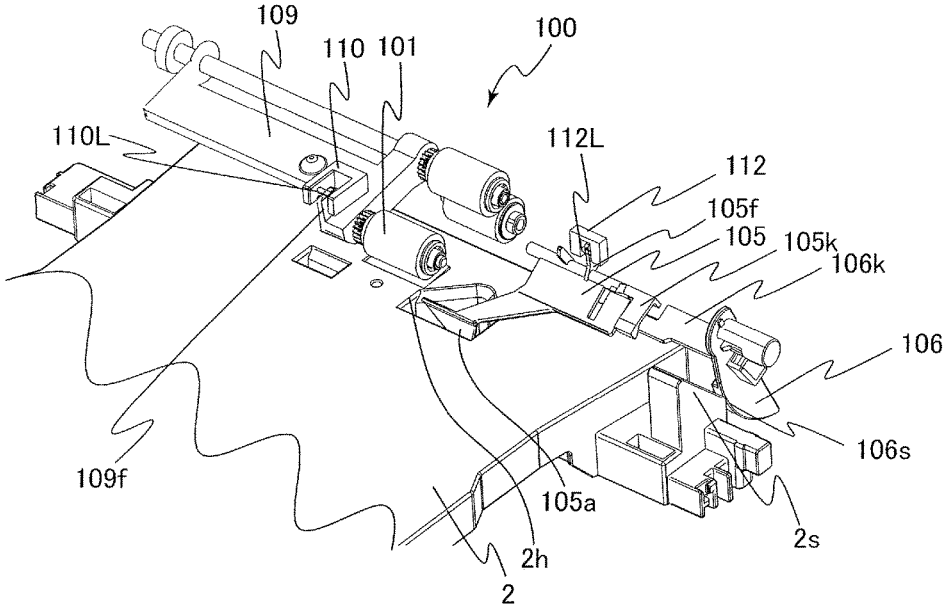
FIG. 8 is a perspective view of the feeding unit when no sheet is supported any longer.

When the tray 2 ascends from the lower limit position toward an upper limit position serving as a second position in accordance with feeding of sheets P as described above, the separation lever 106 is caused to pivot from the holding position to the allowing position by the pressing portion 2*s* of the tray 2 as illustrated in FIG. 8. In a state in which a sheet P is still supported by the tray 2 and the separation lever 106 is positioned at the allowing position, a sufficient distance is ensured between the contact portion 105*k* of the flag member 105 and the cam portion 106*k* of the separation lever 106.

Then, as illustrated in FIG. 8, in the case where the tray 2 is positioned at the upper limit position and no sheet P is supported on the tray 2 any longer, the flag member 105 pivots downward, that is, in the arrow A105 direction illustrated in FIG. 4, due to its own weight, and the abutment portion 105*a* comes down into the hole 2*h* of the tray 2. As a result of this, the flag member 105 is positioned at the lower position, the blocking portion 105*f* of the flag member 105 blocks the optical path 112L of the sheet presence/absence sensor 112, and thus the sheet presence/absence sensor 112 is turned on. When the sheet presence/absence sensor 112 is turned on, the controller 206 illustrated in FIG. 1 notifies the user that no sheet is on the tray 2 by displaying a screen on a panel or the like that is not illustrated or using a warning sound. The flag member 105 positioned at the lower position is held by the tray 2 or the separation lever 106 positioned at the allowing position.

Figure 9:
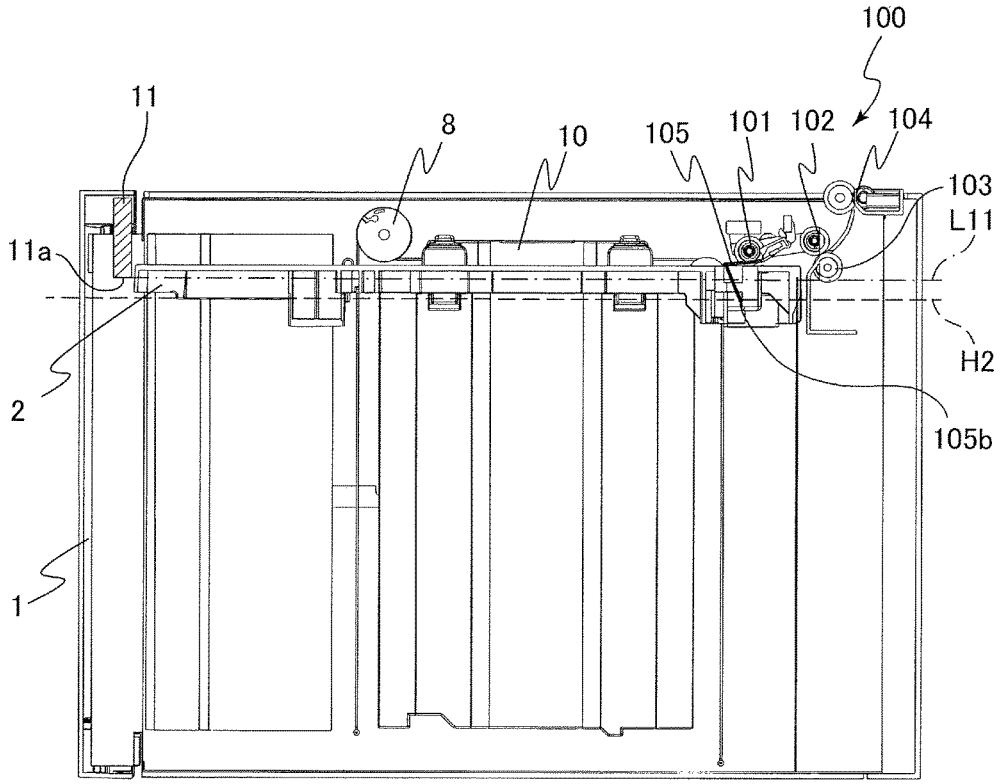
FIG. 9 is a side view of the feeding apparatus for describing the position of the flag member positioned at a lower position.

The lower end 105*b* of the flag member 105 is positioned below the regulation surface 11*a* when the flag member 105 is positioned at the lower position as illustrated in FIG. 9. That is, a height H2 of the lower end 105*b* of the flag member 105 positioned at the lower position is lower than the height L11 of the regulation surface 11*a*. As described above, the lower end 105*b* of the flag member 105 can be positioned below the height L11 of the regulation surface 11*a* equal to the highest surface of sheets that can be supported, and thus the height of the feeding apparatus 203 can be maintained small.

According to this, the presence or absence of a sheet accommodated in the feeding apparatus 203 can be detected without increasing the size of the feeding apparatus 203 in the height direction or reducing the amount of sheets that can be supported. In addition, sheets P can be inserted in the body portion 203A smoothly and thus the usability can be improved.

Second Exemplary Embodiment

Next, a second exemplary embodiment of the present invention will be described. In the second exemplary embodiment, the upper position of the flag member 105 is positioned higher than the upper position of the first exemplary embodiment. Therefore, illustration of the same elements as the first exemplary embodiment will be omitted or given by using the same reference signs.

Figure 10:
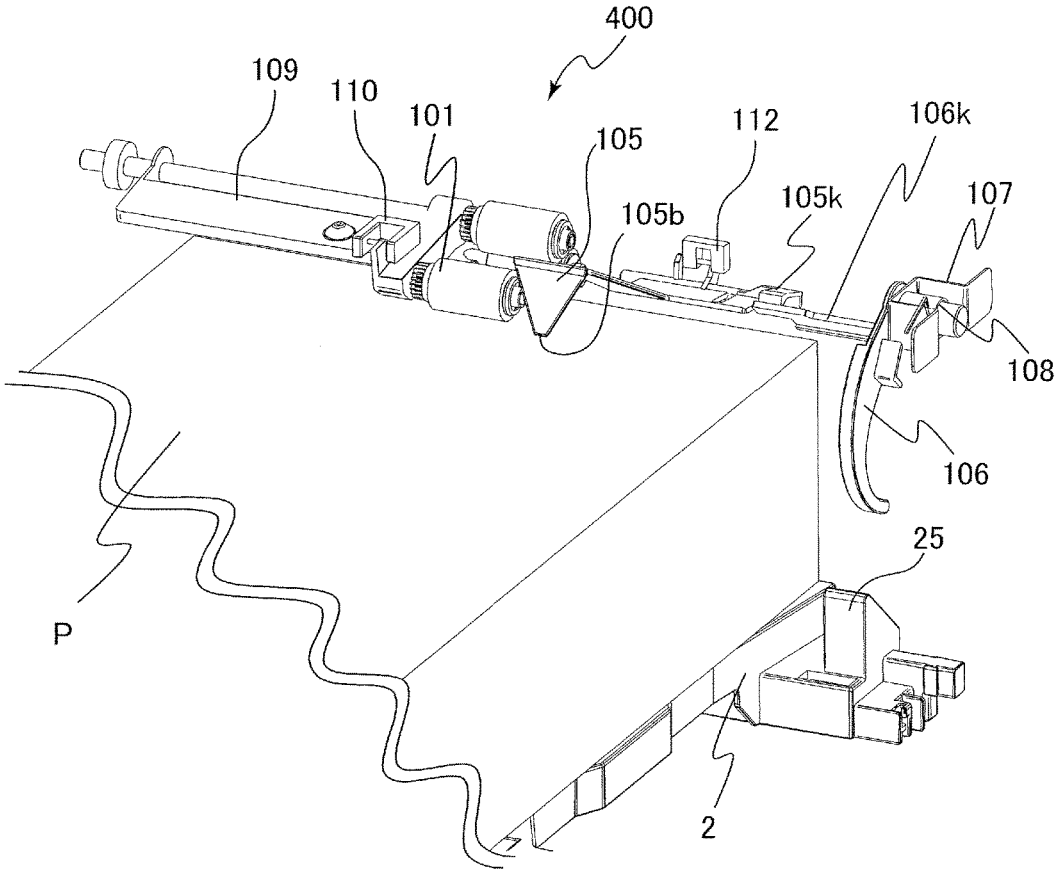
FIG. 10 is a perspective view of a feeding unit according to a second exemplary embodiment.

A feeding unit 400 according to the second exemplary embodiment includes the flag member 105 as illustrated in FIG. 10, and the flag member 105 is supported to be pivotable between the upper position at which the flag member 105 is supported by the separation lever 106 and the lower position. When the flag member 105 is positioned at the lower position, the sheet presence/absence sensor 112 is turned on. The position of the upper surface of a sheet P on the tray 2 is maintained in a certain range when the sheet P is fed by the pickup roller 101.

Figure 11:
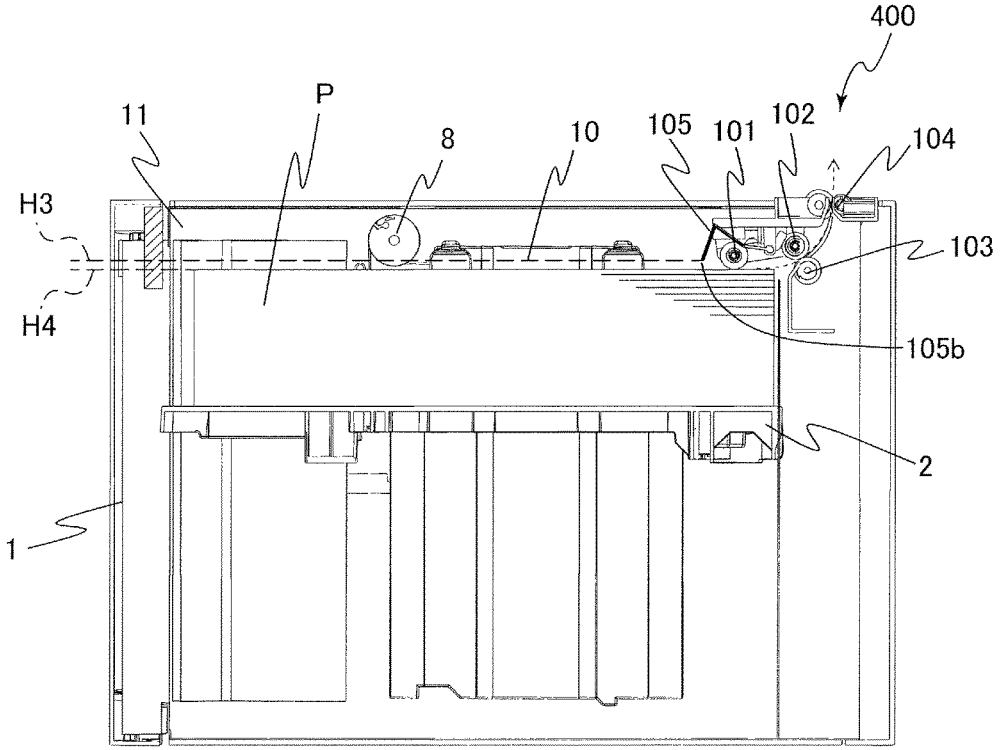
FIG. 11 is a side view of the feeding apparatus for describing the position of a flag member positioned at an upper position.

At this time, the flag member 105 is held at the upper position as a result of the cam portion 106*k* of the separation lever 106 abutting the contact portion 105*k* of the flag member 105. When the flag member 105 is positioned at the upper position, the lower end 105*b* is separated from sheets P as illustrated in FIG. 11. That is, a height H3 of the lower end 105*b* of the flag member 105 positioned at the upper position is higher than a height H4 of the upper surface of a fed sheet. This is because the position of the cam portion 106*k* of the separation lever 106 positioned at the holding position is set to be higher than in the first exemplary embodiment.

In this case, the lower end 105*b* of the flag member 105 hardly slides on a fed sheet P, and thus wearing of the lower end 105*b* can be reduced and the lifetime of the flag member 105 can be elongated.

To be noted, although description has been given in all of the embodiments by using the printer 201 in which a user directly inserts sheets in the body portion 203A, the configuration is not limited to this. For example, a printer in which sheets are set in a cassette drawn out from the body portion 203A may be used. In addition, the tray 2 that is caused to ascend by the wires 3 and 4 may not be used, and sheets may be placed on a pivotable inner plate. In addition, although the flag member 105 has been configured to pivot downward due to its own weight, an urging member that urges the flag member 105 downward may be provided.

In addition, although description has been given in all of the embodiments by using the printer 201 of an electrophotographic system, the present invention is not limited to this. For example, the present invention can be also applied to an image forming apparatus of an inkjet system that forms an image on a sheet by ejecting a liquid ink through a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-020773, filed Feb. 7, 2017, which is hereby incorporated by reference wherein in its entirety.

What is claimed is:

1. A sheet supporting apparatus comprising:

a sheet supporting portion configured to support a sheet and to move between a first position and a second position positioned above the first position;

a flag portion supported to be movable between an upper position and a lower position and configured to be positioned at the lower position in a case where the sheet is not supported by the sheet supporting portion positioned at the second position;

a detection portion configured to detect that the flag portion is positioned at the lower position; and a holding portion configured to move between a holding position and an allowing position, wherein, at the holding position, the holding portion supports the flag portion at the upper position in a case where the sheet supporting portion is positioned at the first position, and, at the allowing position, the holding portion allows movement of the flag portion to the lower position in a case where the sheet supporting portion is positioned at the second position, wherein the sheet supporting portion comprises a pressing portion configured to press the holding portion, and wherein the holding portion is pressed by the pressing portion from the holding position toward the allowing position in a case where the sheet supporting portion moves from the first position to the second position.

2. The sheet supporting apparatus according to claim 1, further comprising a feeding portion configured to feed the sheet supported by the sheet supporting portion, wherein the lower end of the flag portion is configured to move following an upper surface of the sheet supported by the sheet supporting portion, and is configured to slide on the sheet fed by the feeding portion in a case where the flag portion is not positioned at the lower position.

3. The sheet supporting apparatus according to claim 1, further comprising a feeding portion configured to feed the sheet supported by the sheet supporting portion, wherein the lower end of the flag portion is separated from the sheet fed by the feeding portion in a case where the flag portion is positioned at the upper position.

4. The sheet supporting apparatus according to claim 1, wherein the sheet supporting portion comprises a supporting surface configured to support the sheet and provided with a hole therein, and wherein the lower end of the flag portion is inserted into the hole in a case where the flag portion moves to the lower position.

5. The sheet supporting apparatus according to claim 1, further comprising a regulation member comprising a regulation surface configured to regulate a height of the sheet supported by the sheet supporting portion, wherein a lower end of the flag portion is positioned above the regulation surface in a case where the flag portion is positioned at the upper position, and is positioned below the regulation surface in a case where the flag portion is positioned at the lower position.

6. The sheet supporting apparatus according to claim 5, further comprising a body portion configured to support the sheet supporting portion such that the sheet supporting portion is capable of ascending and descending and allow a sheet to be inserted therein, wherein the regulation member is disposed on an upstream side of the body portion in a sheet inserting direction.

7. The sheet supporting apparatus according to claim 1, wherein the flag portion is urged toward the lower position by its own weight.

8. The sheet supporting apparatus according to claim 1, further comprising an urging portion configured to urge the holding portion toward the holding position.

9. An image forming apparatus comprising:

the sheet supporting apparatus according to claim 1; and an image forming portion configured to form an image on a sheet fed from the sheet supporting apparatus.

* * * * *